US007530671B2

(12) United States Patent
Kosugi

(10) Patent No.: US 7,530,671 B2
(45) Date of Patent: May 12, 2009

(54) PRINTING APPARATUS RECOVERING MIST-LIKE INK DROPLETS

(75) Inventor: Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 427 days.

(21) Appl. No.: 11/390,219

(22) Filed: Mar. 28, 2006

(65) Prior Publication Data

US 2006/0232632 A1 Oct. 19, 2006

(30) Foreign Application Priority Data

Mar. 28, 2005 (JP) ..... 2005-092311

(51) Int. Cl.
*B41J 2/06* (2006.01)

(52) U.S. Cl. ..... 347/55; 347/34

(58) Field of Classification Search ..... 347/22–24, 347/29–31, 34–36, 44, 50, 55, 104, 112
See application file for complete search history.

(56) References Cited

U.S. PATENT DOCUMENTS

| | | | | |
|---|---|---|---|---|
| 4,628,331 | A * | 12/1986 | Ishikawa | 347/34 |
| 5,298,926 | A | 3/1994 | Fukushima et al. | 347/34 |
| 7,052,109 | B2 * | 5/2006 | Unosawa | 347/34 |

FOREIGN PATENT DOCUMENTS

| | | | |
|---|---|---|---|
| JP | 05-000518 | A | 1/1993 |
| JP | 05-338206 | A | 12/1993 |
| JP | 10-264412 | A | 10/1998 |
| JP | 2002-205415 | A | 7/2002 |
| JP | 2003-014773 | A | 1/2003 |

* cited by examiner

*Primary Examiner*—Juanita D Stephens
(74) *Attorney, Agent, or Firm*—Sughrue Mion, PLLC

(57) ABSTRACT

A printing apparatus includes a carriage and an electrode. The carriage is for moving a nozzle. The electrode moves with the carriage, and is adapted to attract an electrically-charged ink droplet ejected from the nozzle but not landing on a medium.

14 Claims, 13 Drawing Sheets

PRINTING APPARATUS RECOVERING MIST-LIKE INK DROPLETS

CROSS-REFERENCE TO RELATED APPLICATIONS

The present application claims priority upon Japanese Patent Application No. 2005-092311 filed on Mar. 28, 2005, which is herein incorporated by reference.

BACKGROUND

1. Technical Field

The present invention relates to printing apparatuses.

2. Related Art

The inkjet printer ejects ink droplets from a nozzle moving in the moving direction and forms dots with the ink droplets landing on a medium (such as paper, cloth, and OHP sheets). In this way, the printer prints a print image made up of innumerable dots on the medium.

When very small droplets of ink are ejected from a nozzle, the flying speed of the ink droplets is lowered due to air resistance, and some of the droplets are scattered inside the printer without landing on the medium. Such mist-like ink droplets are a troublesome contaminant to the printer.

According to a known technique disclosed in JP-A-2002-205415, an ink absorbing material is provided on the side surface of a carriage and mist-like ink droplets are recovered using an airflow created around the carriage when the carriage moves.

In order to recover mist-like ink droplets using such an ink absorbing material, ink droplets carried by an airflow must move at such a speed that the droplets collide against the ink absorbing material. Stated differently, only ink droplets moving at such a speed that they collide against the ink absorbing material can be recovered using the ink absorbing material. Among mist-like ink droplets, some moves toward the ink absorbing material but not fast enough to collide against the ink absorbing material. Such ink droplets cannot be recovered.

SUMMARY

It is an object of the invention to increase the efficiency of recovering mist-like ink droplets.

An aspect of the invention is a printing apparatus including: a carriage for moving a nozzle; and an electrode that moves with the carriage, the electrode being adapted to attract an electrically-charged ink droplet ejected from the nozzle but not landing on a medium.

Other aspects of the invention will become apparent from the description and the accompanying drawings.

DESCRIPTION OF EXEMPLARY EMBODIMENTS

Figure 1:
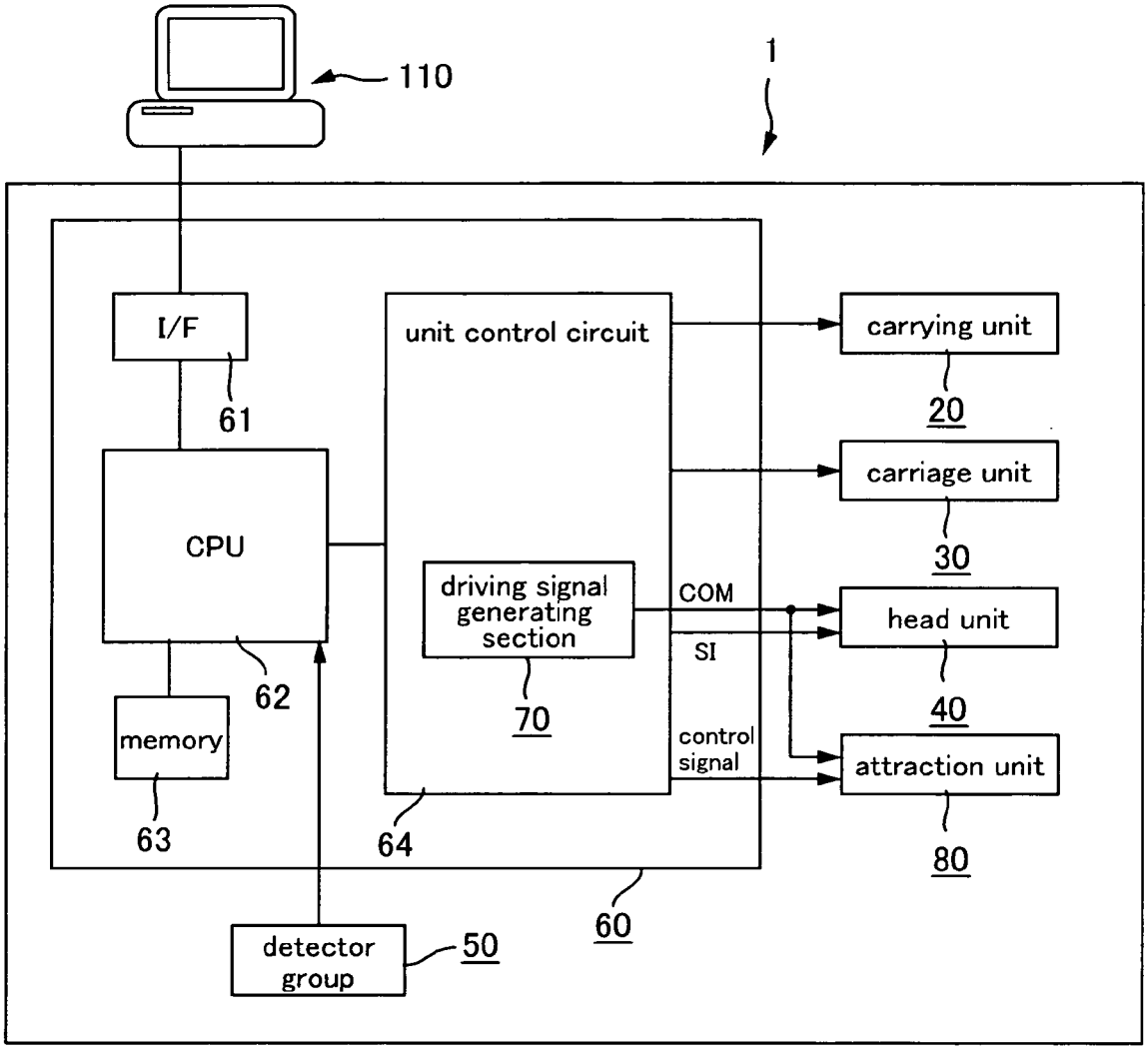
FIG. 1 is a block diagram of a general structure of a printer.

From the description of this specification and the accompanying drawings, at least the following will become apparent.

A printing apparatus includes:

a carriage for moving a nozzle; and an electrode that moves with the carriage, the electrode being adapted to attract an electrically-charged ink droplet ejected from the nozzle but not landing on a medium.

Such a printing apparatus allows ink droplets to be less scattered.

In this printing apparatus, it is preferable that the electrode is provided on a side surface of the carriage in a moving direction of the carriage. In this way, ink droplets can efficiently be attracted.

In this printing apparatus, it is preferable that a main ink droplet and a satellite ink droplet are ejected from the nozzle, and the satellite ink droplet is attracted by the electrode. In this way, the satellite ink droplets that are easily changed into a mist state can be less scattered.

In this printing apparatus, it is preferable that the printing apparatus further includes a driving signal generating section for generating a driving signal that drives an element for causing an ink droplet to be ejected from the nozzle, and a charging circuit for charging the electrode using the signal output from the driving signal generating section. In this way, the structure of the apparatus can be simplified.

In this printing apparatus, it is preferable that the charging circuit has a filter that cuts a DC component of the signal output from the driving signal generating section. In this way, short-circuiting can be prevented. Further, it is preferable that the charging circuit has a transformer that converts a voltage of the signal whose DC component has been cut. In this way, many ink droplets can be attracted. Further, it is preferable that the charging circuit has a rectifier circuit provided on a secondary side of the transformer. In this way, the voltage of the charged electrode can be maintained.

Further, it is preferable that the charging circuit has a switch for controlling on/off of a charging operation which uses the signal output from the driving signal generating section. Further, it is preferable that the switch is turned off when an ink droplet is to be ejected from the nozzle. In this way, the image quality of the printed images is improved. Further, it is preferable that the switch is turned on when the element is to be driven to such a degree that no ink droplet is ejected from the nozzle, and it is also preferable that the electrode is charged before an ink droplet is ejected from the nozzle. In this way, mist-like ink droplets can be attracted before scattering.

In this printing apparatus, it is preferable that the electrode is covered. In this way, short-circuiting that would otherwise be caused by ink droplets adhering to the electrode can be prevented. Further, it is preferable that the printing apparatus further includes an ink absorbing material that moves with the carriage. In this way, ink droplets attracted to the electrode can be absorbed by the ink absorbing material.

Structure of Printer

<Structure of Inkjet Printer>

Figure 2A:
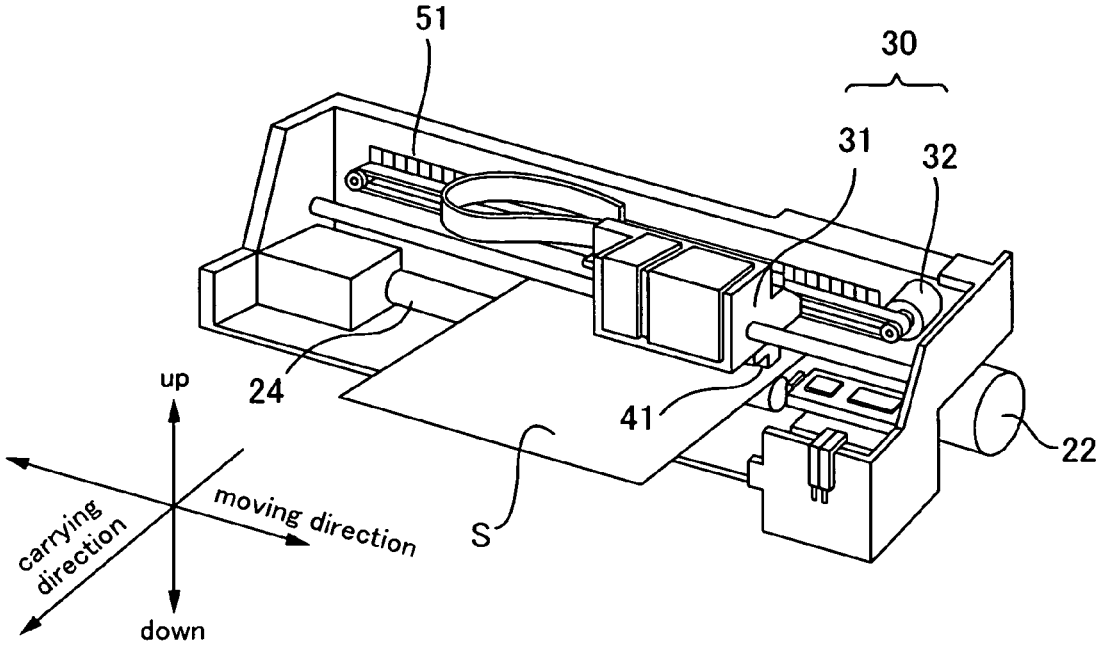
FIG. 2A is a schematic diagram of a general structure of the printer.
Figure 2B:
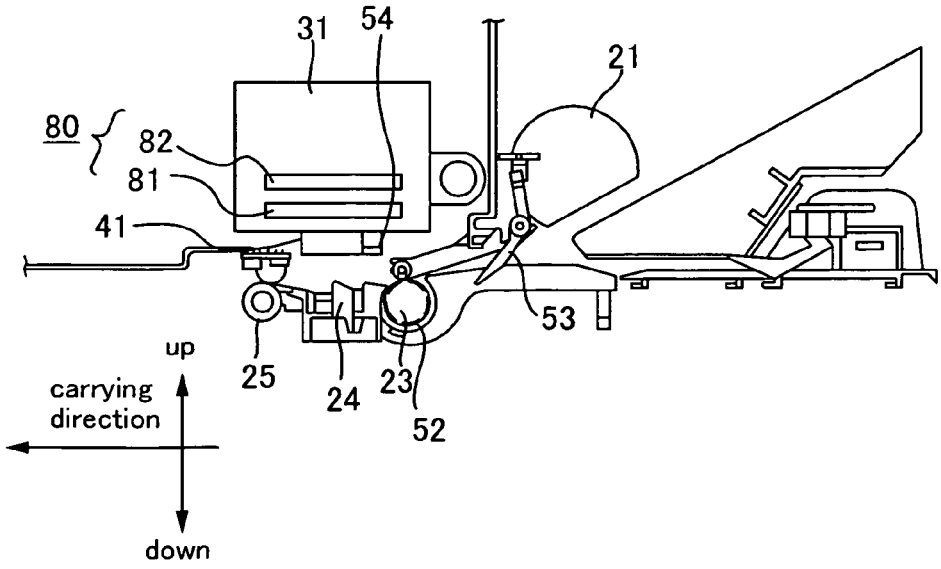
FIG. 2B is a cross sectional view of a general structure of the printer.

FIG. 1 is a block diagram of the general configuration of a printer 1 according to an embodiment of the invention. FIG. 2A is a schematic diagram of the general structure of the printer 1 according to the embodiment. FIG. 2B is a cross sectional view of the general structure of the printer 1 according to the embodiment. Now, the basic structure of the printer according to the embodiment will be described.

The printer 1 according to the embodiment includes a carrying unit 20, a carriage unit 30, a head unit 40, a detector group 50, and a controller 60. The printer 1 receives print data from a computer 110 as an external device and controls various units (the carrying unit 20, the carriage unit 30, the head unit 40, and the attraction unit 80) using the controller 60. The controller 60 controls these units to print an image on paper based on the print data received from the computer 110. The state inside the printer 1 is monitored by the detector group 50, and the detector group 50 outputs the result of detection to the controller 60. The controller 60 controls the respective units in response to the detection results output from the detector group 50.

The carrying unit 20 is used to carry a medium (such as paper S) in a prescribed direction (hereinafter referred to as "carrying direction"). The carrying unit 20 includes a paper supply roller 21, a carrying motor 22 (also referred to as "PF motor"), a carrying roller 23, a platen 24, and a paper discharge roller 25. The paper supply roller 21 supplies paper inserted through a paper insert inlet into the printer. The carrying roller 23 is driven by the carrying motor 22 to carry the paper S supplied by the paper supply roller 21 to a region where printing is enabled. The platen 24 supports the paper S in the process of printing. The paper discharge roller 25 is provided downstream in the carrying direction with respect to the region where printing is enabled and discharges the paper S out from the printer.

The carriage unit 30 moves (or "scans") the head in a prescribed direction (hereinafter referred to as "moving direction"). The carriage unit 30 includes a carriage 31 and a carriage motor 32 (also referred to as "CR motor"). The carriage 31 can move back and forth in the moving direction and is driven by the carriage motor 32. The carriage 31 also detachably holds an ink cartridge that stores ink.

The head unit 40 ejects ink onto paper. The head unit 40 includes a head 41 having a plurality of nozzles. The head 41 is provided in the carriage 31, and therefore when the carriage 31 moves in the moving direction, the head 41 also moves in the moving direction. The head 41 intermittently ejects ink while the head moves in the moving direction, so that a dot line (raster line) in the moving direction is formed on paper.

The detector group 50 includes a linear encoder 51, a rotary encoder 52, a paper detecting sensor 53, and an optical sensor 54. The linear encoder 51 detects the position of the carriage 31 in the moving direction. The rotary encoder 52 detects the amount of rotation of the carrying roller 23. The paper detection sensor 53 detects the position of the front end of a paper sheet being supplied. The optical sensor 54 detects the presence/absence of paper by a light emitting section and a light receiving section attached to the carriage 31. The optical sensor 54 can detect the positions of the edges of the paper sheet while moving with the carriage 31 to detect the width of the paper sheet. The optical sensor 54 can also detect the leading end (that is, the downstream end in the carrying direction and also referred to as "upper end") and the rear end (that is, the upstream end in the carrying direction and also referred to as "lower end") as the case may be.

The controller 60 is a control unit (control section) used to control the printer. The controller 60 includes an interface section 61, a CPU 62, a memory 63, and a unit control circuit 64. The interface section 61 serves to carry out data transmission/reception between the computer 110 as an external device and the printer 1. The CPU 62 is an operation processing unit used to control the entire printer. The memory 63 is used to reserve an area for storing programs for the CPU 62, a work area, or the like and includes a storage device such as a RAM and an EEPROM. The CPU 62 controls the units according to programs stored in the memory 63 through the unit control circuit 64.

The unit control circuit 64 includes a driving signal generating section 70 that generates driving signals COM. The driving signals COM are used to drive the head unit 40 and the attraction unit 80 and input from the driving signal generating section 70 to the head unit 40 and the attraction unit 80.

The attraction unit 80 has a mechanism for attracting "satellite ink droplets" which are generated when ink droplets are ejected from the head. The attraction unit 80 includes electrodes 81 and 82 for generating an electric field. The electrodes are provided on the side surfaces of the carriage (i.e., the front surface and the back surface of the carriage when viewed in the moving direction of the carriage). Details of the attraction unit 80 will be described later. Note that according to the embodiment, a pair of electrodes is provided on each surface. The invention, however is not limited to this arrangement, and a plurality of pairs may be provided, while one electrode may be provided to protrude from the side of the carriage.

<Printing Operation>

Figure 3:
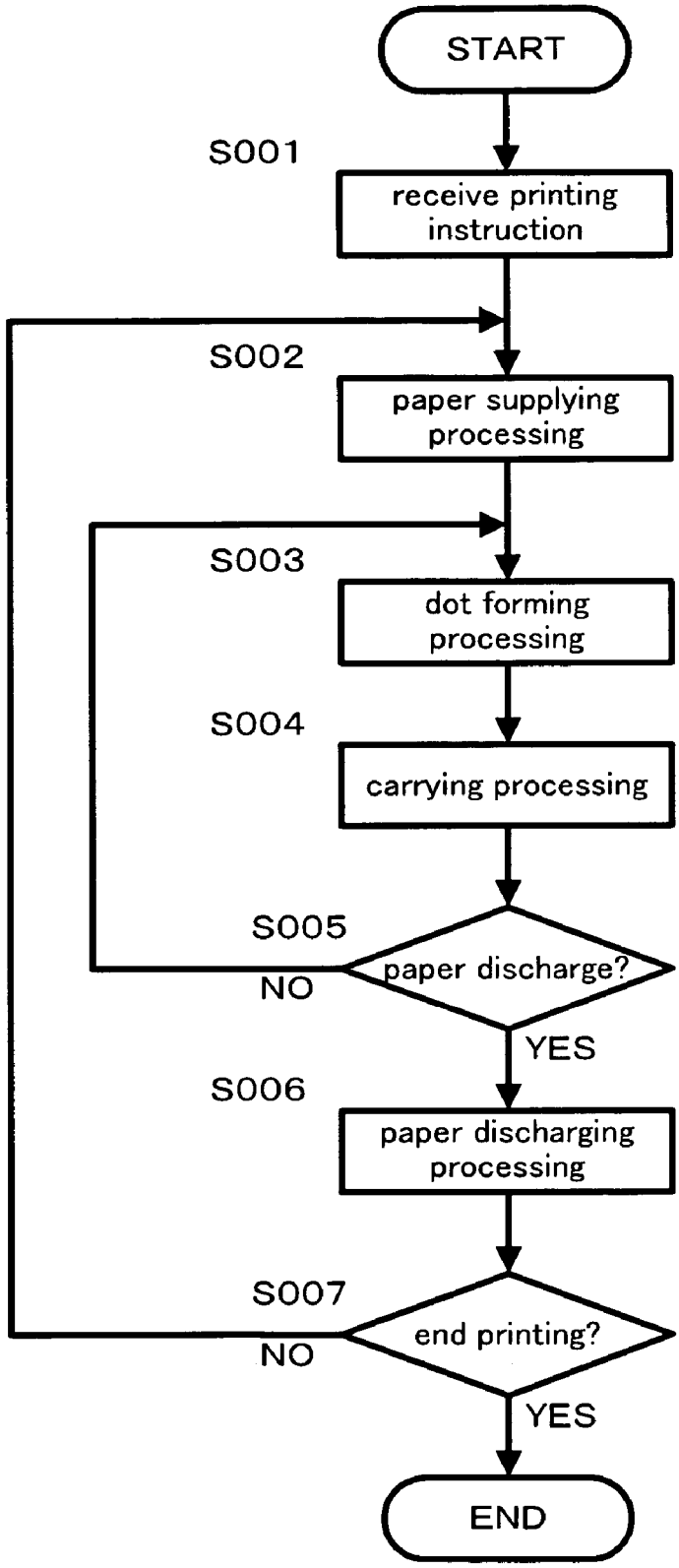
FIG. 3 is a flowchart for use in illustrating processing during printing.

FIG. 3 is a flowchart for processing during printing. The following steps are executed as the controller 60 controls the units according to a program stored in the memory 63. The program has codes to execute the steps.

Receive Printing Instruction (S001)

The controller 60 receives a printing instruction from the computer 110 through the interface section 61. The printing instruction is included in the header of print data transmitted from the computer 110. The controller 60 analyzes the content of various commands included in the received print data and carries out the following paper supplying processing, carrying processing, dot forming processing, and the like using the respective units.

Paper Supplying Processing (S002)

In the paper supplying processing, paper to be printed with data is supplied into the printer and positioned at the printing start position (also referred to as "head positioning"). The controller 60 turns the paper supply roller 21 and sends a paper sheet to be printed to the carrying roller 23. Then, the controller 60 turns the carrying roller 23 and positions the paper sheet sent from the paper supply roller 21 in the printing start position. When the paper sheet is positioned in the printing start position, at least some of the nozzles of the head 41 oppose the paper sheet.

Dot Forming Processing (S003)

In the dot forming processing, ink is intermittently ejected from a head moving in the moving direction to allow dots to form on the paper. The controller 60 drives the carriage motor 32 to move the carriage 31 in the moving direction. The controller 60 then allows ink to be ejected from the head based on the print data during the movement of the carriage 31. Ink droplets ejected from the head 41 and landing on the paper form dots on the paper. Ink is intermittently ejected from the moving head 41, and therefore a dot row (raster line) made up of a plurality of dots is formed in the moving direction on the paper.

Carrying Processing (S004)

In the carrying processing, the paper is moved relatively to the head in the carrying direction. The controller 60 drives the carrying motor to rotate the carrying roller, so that the paper is carried in the carrying direction. By the carrying processing, the head 41 can form dots in a position different from the position of dots formed by the previous dot forming processing.

Paper Discharging Determination (S005)

The controller 60 determines whether or not to discharge the paper being printed. If there is data yet to be printed on paper, the paper is not discharged. The controller 60 alternately repeats the dot forming processing and the carrying processing while gradually printing an image consisting of the dots on the paper until there is no more data to be printed.

Paper Discharging Processing (S006)

Once there is no more data to be printed on the paper in the process of printing, the controller 60 rotates the paper discharge roller to discharge the paper. Note that whether or not to discharge the paper may be determined based on a paper discharge command included in the print data.

Printing End Determination (S007)

Then, the controller 60 determines whether or not to continue printing. If printing is to be continued on the next sheet of paper, printing is continued and the next sheet of paper starts to be fed. If the next sheet is not to be printed, the printing operation is ended.

<Driving Signal Generating Section>

Figure 4:
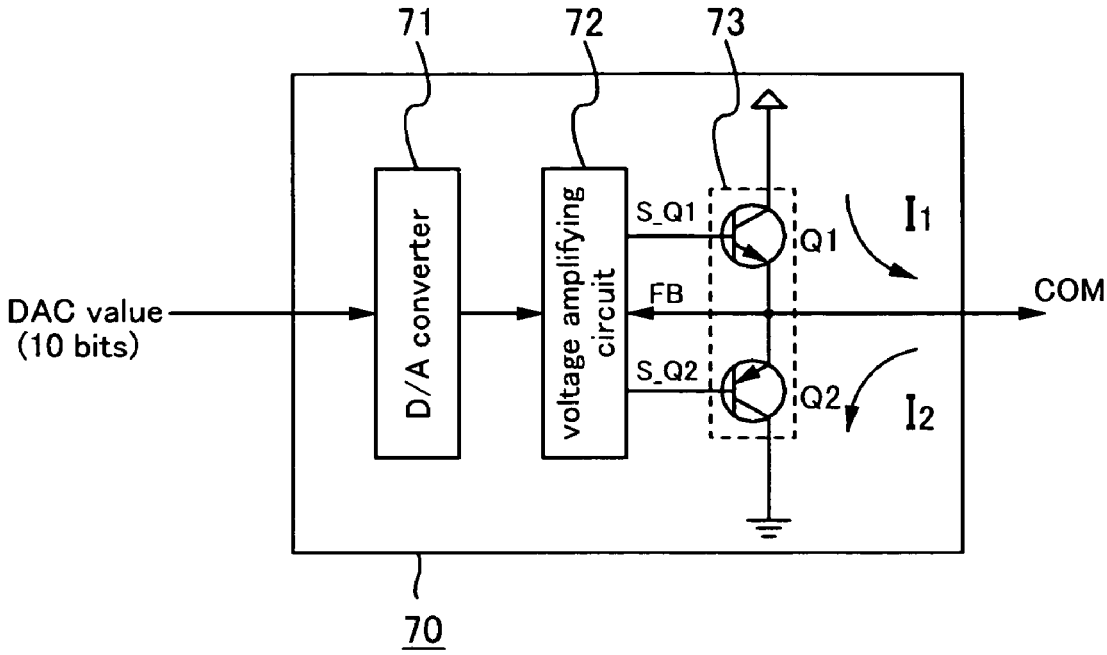
FIG. 4 is a diagram of a configuration of a driving signal generating section 70.

FIG. 4 is a diagram for use in illustrating the structure of the driving signal generating section 70. The driving signal generating section 70 includes a D/A converter 71, a voltage amplifying circuit 72, and a current amplifying circuit 73.

The D/A converter 71 outputs a signal at a voltage corresponding to a DAC value output from the CPU 62 to the voltage amplifying circuit 72. The voltage amplifying circuit 72 amplifies the signal from the D/A converter 71 to a voltage level suitable for the operation of a piezo element 411. The voltage amplifying circuit 72 amplifies the signal from the D/A converter 71 to 40—some V at most. The amplified output voltage is output to the current amplifying circuit 73 as signals S_Q1 and S_Q2.

The current amplifying circuit 73 is used to supply a current enough for a large number of piezo elements in the head 41 to operate without faults. The current amplifying circuit 73 has a transistor pair consisting of an NPN transistor Q1 and a PNP transistor Q2 having their emitter terminals connected with each other. The NPN transistor Q1 operates when the voltage of a driving signal COM rises. The NPN transistor Q1 has its collector connected to a power supply and its emitter connected to the output signal line for the driving signal COM. The PNP transistor Q2 operates when the voltage drops. The PNP transistor Q2 has its collector connected to ground (earth) and its emitter connected to the output signal line for the driving signal COM. Note that the voltage at the connecting part between the emitters of the NPN transistor Q1 and the PNP transistor Q2 (the voltage of the driving signal COM) is fed back to the voltage amplifying circuit 72 as denoted by the reference character FB.

The current amplifying circuit 73 has its operation controlled in response to the signals S_Q1 and S_Q2 from the voltage amplifying circuit 72. When, for example, the output voltage is in a raised state, the NPN transistor Q1 turns on in response to the signal S_Q1, and a current I1 is passed therethrough. In response, the voltage of the driving signal COM rises. Meanwhile, when the output voltage is in a dropped state, the PNP transistor Q2 turns on in response to the signal S_Q2, and a current I2 is passed therethrough. In response, the voltage of the driving signal COM drops. Note that when the output voltage is constant, the NPN transistor Q1 and the PNP transistor Q2 are both in an off state. Consequently, the driving signal COM is at a constant voltage.

As will be described, the driving signal generating section 70 can generate two kinds of driving signals (driving signals COM_1 and COM_2).

<Driving Signal COM>

Figure 5:
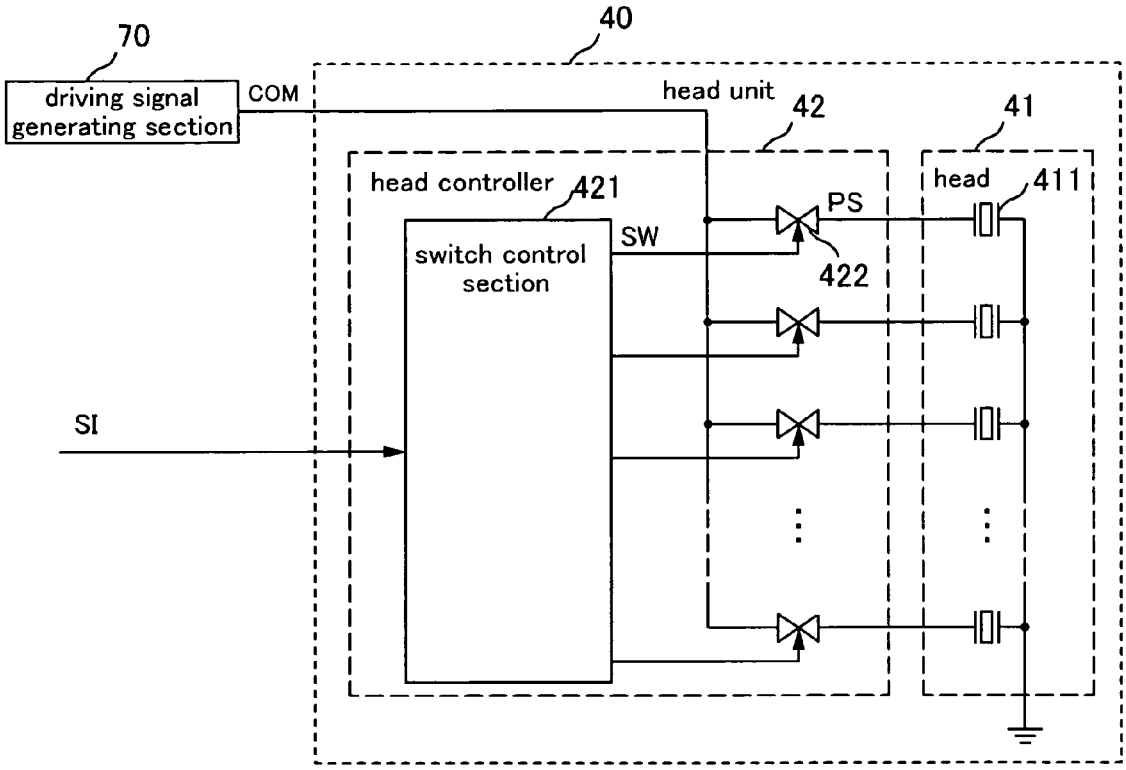
FIG. 5 is a diagram of a configuration of a head unit 40.
Figure 6:
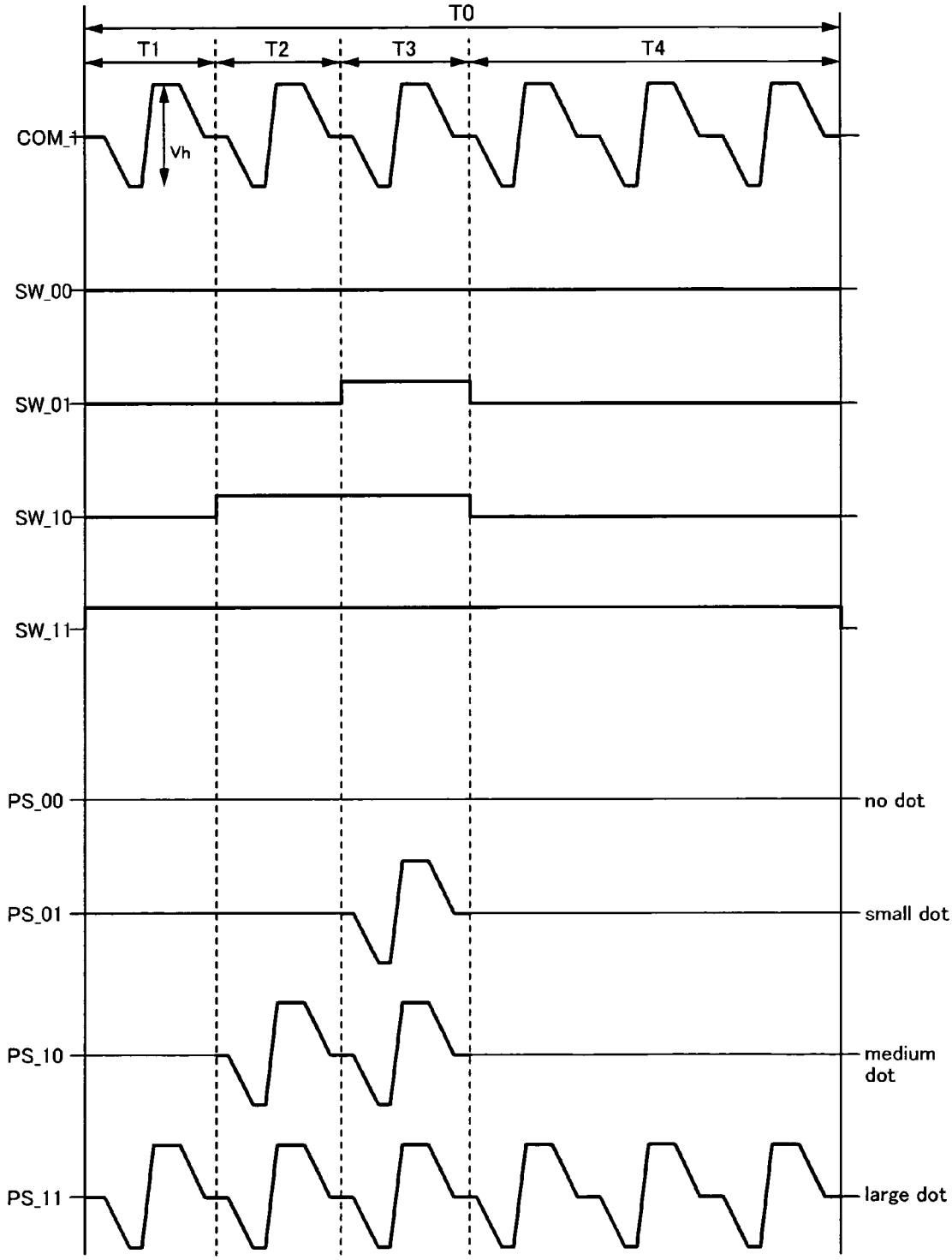
FIG. 6 is a chart for use in illustrating a driving signal COM_1, switching signals SW, and applied signals PS during dot forming processing.

FIG. 5 is a diagram for use in illustrating the structure of the head unit 40. FIG. 6 is a chart showing the driving signal COM_1, switch control signals SW, and applied signals PS during dot forming processing.

The head unit 40 has a head controller 42 that controls the head 41 in addition to the head 41. The head 41 includes a plurality of piezo elements 411 corresponding to the nozzles. The head controller 42 has a switch control section 421 and switches 422 provided corresponding to the respective piezo elements 411.

The driving signal COM_1 during the dot forming processing includes six driving pulses during a period T0. Note that the period T0 corresponds to an interval during which the carriage moves for one pixel. The voltage Vh from the minimum potential to the maximum potential of the driving signal COM_1 during the dot forming processing is approximately 36 V. The driving signal COM_1 is output from the driving signal generating section 70 and input to the switches 422.

The head controller is provided with a control signal SI from the controller 60. The control signal SI is serial data of pixel data for the number of nozzles. The switch control section 421 outputs the switch control signal SW in response to 2-bit pixel data corresponding to each of the nozzles based on the control signal SI.

If 2-bit pixel data corresponding to a certain nozzle is "00," the switch control section 421 outputs a switch control signal SW_00 as shown in the figure to the switch 422 corresponding to the pixel data. The switch control section 421 outputs a switch control signal SW_01 for pixel data "01," a switch control signal SW_10 for pixel data "10," and a switch control signal SW_11 for pixel data "11" to the switch 422.

When the switch control signal SW is at the L level, the switch 422 attains an off state. Meanwhile, the switch 422 turns on when the switch control signal SW is at the H level. As a result, when the pixel data is "00," the switch control signal SW_00 is kept at the L level during the period T0, and none of the driving pulses of the driving signal COM_1 is applied to the piezo elements 411. Therefore, when the pixel data is "00," no dot forms. When the pixel data is "01," the switch control signal SW_01 attains an H level during the period T3, and therefore one driving pulse is applied to the piezo element 411 during the period, so that a small size dot forms. When the pixel data is "10," two driving pulses are applied to the piezo element 411, and a middle size dot forms.

When the pixel data is "11," the six driving pulses are applied to the piezo element 411, so that a large size dot forms.

Figure 7:
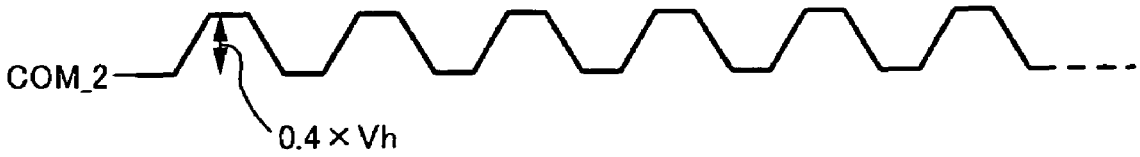
FIG. 7 is a chart for use in illustrating a driving signal COM_2 other than during dot forming processing.

FIG. 7 is a chart showing the driving signal COM_2 other than during the dot forming processing.

When dot forming processing is not carried out, no ink droplet is ejected from the nozzles other than during flushing processing (as will be described). When no ink droplet is ejected from the nozzles for a long period of time, the nozzles could be clogged. Therefore, the controller 60 drives the piezo elements 411 even when no ink droplet is ejected from the nozzles in order to prevent the nozzles from being clogged.

At the time, the difference between the minimum potential and the maximum potential of the driving signal COM_2 that drives the piezo elements 411 is about 0.4 times as large as the difference Vh between minimum potential and the maximum potential of the driving signal COM_1 during the dot forming processing. In this way, since the difference between the minimum potential and the maximum potential of the driving signal COM_2 is small except during dot forming processing, the piezo elements 411 are driven to such a degree that no ink droplet is ejected from the nozzles, and the ink in the nozzles can be stirred in this manner. Note that the driving signal COM_2 at the time is also referred to as "micro-vibration signal."

Meanwhile, there is also processing called "flushing processing" as means for preventing the nozzles from being clogged. In this processing, the controller 60 moves the carriage 31 to an ink receiving section in a non-printing region, and several ink droplets are ejected from the nozzles. Therefore, during the processing, the driving signal generating section 70 outputs the driving signal COM_1 as shown in FIG. 6.

Attraction Unit

<Necessity of Attraction Unit (How Satellite Ink Droplets Form)>

FIGS. 8A to 8E are diagrams for use in illustrating how an ink droplet is ejected from a nozzle. Now, in the following description, + and – signs shown in these figures, which relate to charges, are ignored at first.

Figure 8A:
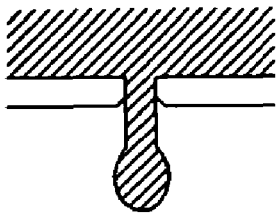
FIGS. 8A to 8E are diagrams showing how an ink droplet is ejected from a nozzle.
Figure 8B:
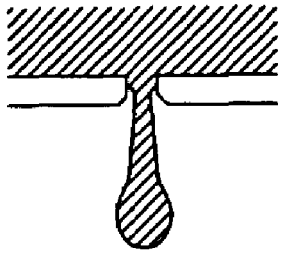
Figure 8C:
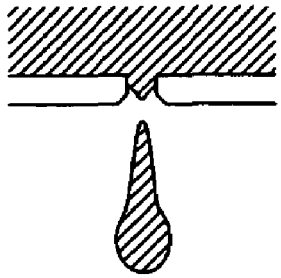

In response to a driving pulse applied to the piezo elements 411 (not shown), the pressure in the ink chamber changes, so that an ink meniscus protrudes from the nozzle (FIG. 8A). As the ink meniscus from the nozzle extends in a column shape, a narrow part forms in the vicinity of the nozzle (FIG. 8B). The meniscus is separated at the narrow part, and an ink droplet forms (FIG. 8C). A narrow part also forms in the ink droplet (FIG. 8D), and the ink droplet is separated at the part, and a main ink droplet Im, which is an ink droplet large in size, forms on the paper side and a satellite ink droplet Is, which is a very small ink droplet, forms on the nozzle side (FIG. 8E).

Figure 8D:
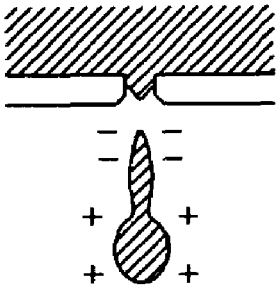
Figure 8E:
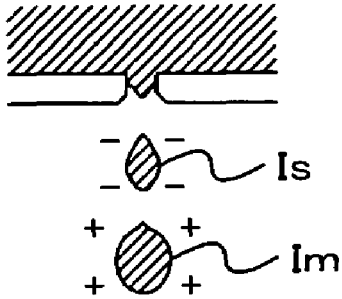

It has been known from experiments that the satellite ink Is is generated together with the main ink droplet Im as shown in FIG. 8E. Meanwhile, there is no way to know the mechanism of how the satellite ink droplet Is forms (the process from FIGS. 8A to 8E) and the idea is based on simulations. Herein, the fact that the satellite ink droplet Is forms should be noted rather than the mechanism of how it forms. Even if such satellite droplets Is are formed through different mechanisms, the following embodiment can be applied as long as the satellite ink droplets Is are formed. Stated differently, according to the invention, the term "satellite ink droplet Is" is not limited to that generated by the mechanism shown in FIGS. 8A to 8E, but it broadly refers to any ink droplet separately generated when a main ink droplet Im is ejected.

The satellite ink droplet Is may not land on paper S because of air resistance while it flies toward the paper S, due to the satellite ink droplet Is having a small weight or flying slowly. The satellite ink droplet Is not landing on the paper S scatters in the printer and gives rise to contamination in the printer. According to the embodiment, the attraction unit 80 is provided to the carriage 31 to recover the scattering satellite ink droplet Is (satellite ink droplet turned into a mist state) in the printer.

It has been evident from experiments that as shown in FIG. 8E, a main ink droplet Im is positively charged, and a satellite ink droplet Is is negatively charged. This is probably because the friction between the nozzle and ink during the ejection of the ink droplet causes the ink droplet to be polarized as shown in FIG. 8D, and as a result, when the ink is separated into the main ink droplet Im and the satellite ink droplet Is as in FIG. 8E, the main ink droplet is positively charged, and the satellite ink droplet is negatively charged. However, as with the mechanism of how the satellite ink droplet Is forms, the fact that the satellite ink droplet is charged should be noted rather than the mechanism of how it is charged. Even if the satellite ink droplet Is is charged by different mechanisms, the following embodiment can be applied as long as the satellite ink droplet Is is charged. Stated differently, according to the invention, the "electrically-charged satellite ink droplet Is" does not always refer to that formed by the mechanism shown in FIGS. 8D and 8E.

The attraction unit 80 according to the embodiment recovers mist-like satellite ink droplets taking advantage of the fact that the satellite ink droplets are electrically charged.

<Structure of Attraction Unit 80>

Figure 9:
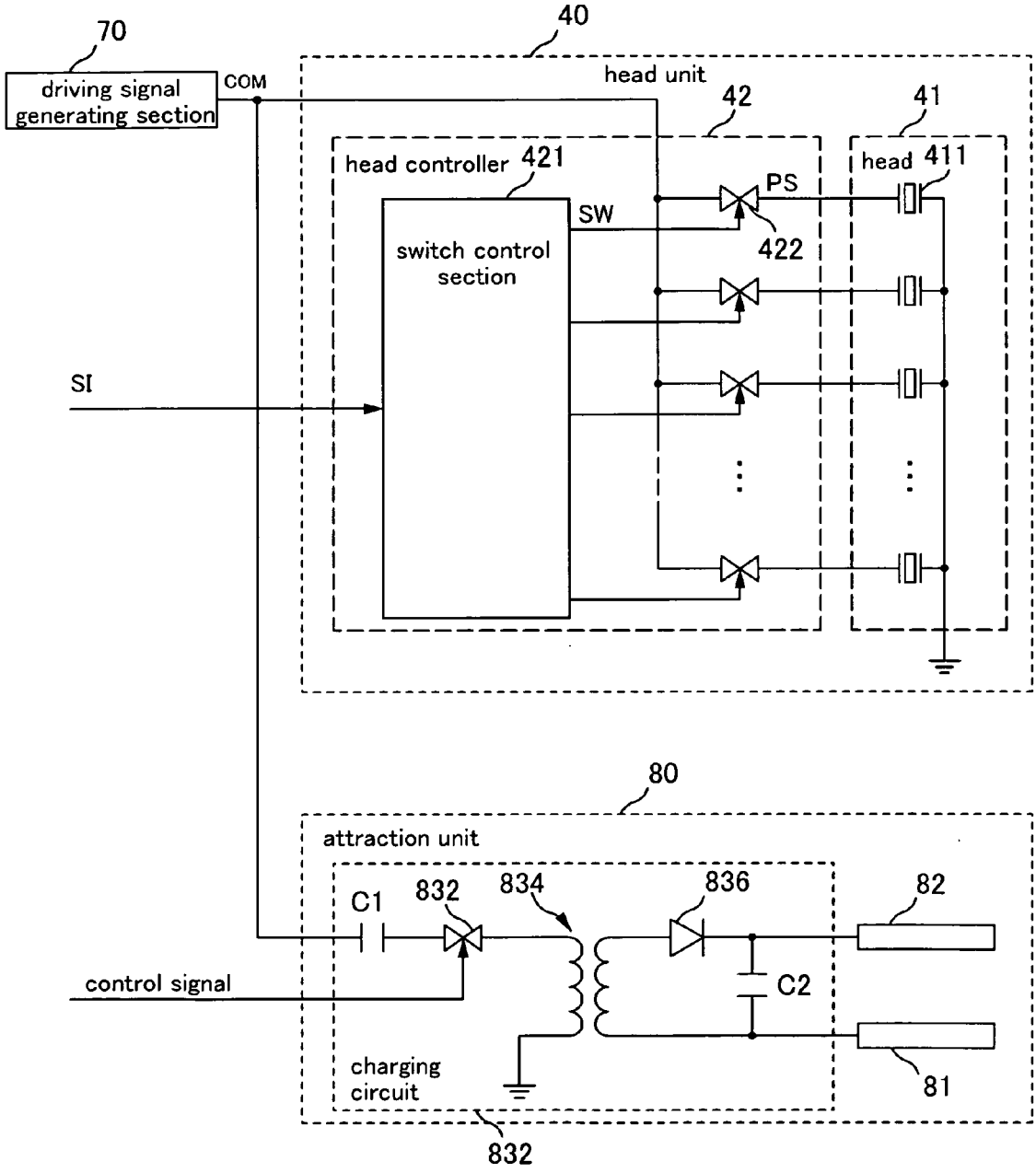
FIG. 9 is a diagram of a configuration of an attraction unit 80 according to an embodiment of the invention.

FIG. 9 is a diagram showing the structure of the attraction unit 80 according to the embodiment. The head unit 40 shown in FIG. 9 has already been described and the description thereof will not be repeated.

The attraction unit 80 as described above has a mechanism for attracting satellite ink droplets, and the electrodes 81 and 82 of the attraction unit 80 are provided on each side surface of the carriage 31 (see FIG. 2B). The attraction unit 80 is provided with the driving signal COM generated by the driving signal generating section 70, and a control signal from the controller 60.

In addition to the electrodes 81 and 82, the attraction unit 80 includes a charging circuit 83 that charges the electrodes. The charging circuit 83 includes a capacitor C1, a switch 832, a transformer 834, a diode 836, and another capacitor C2. The capacitor C1 cuts the DC component of the driving signal COM. The switch 832 is controlled to turn on and off in response to the control signal from the controller 60. The transformer 834 converts voltage from a low level to a high level. Note that the primary winding of the transformer 834 is provided on the side of the switch 832, and the secondary winding of the transformer 834 is on the electrode side. The diode 836 and the capacitor C2 form a rectifier circuit.

Figure 10A:
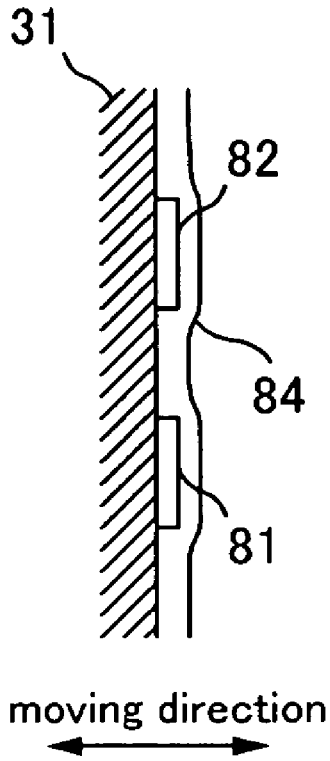
FIGS. 10A and 10B are diagrams for use in illustrating electrodes 81 and 82 provided on the side surface of a carriage 31.
Figure 10B:
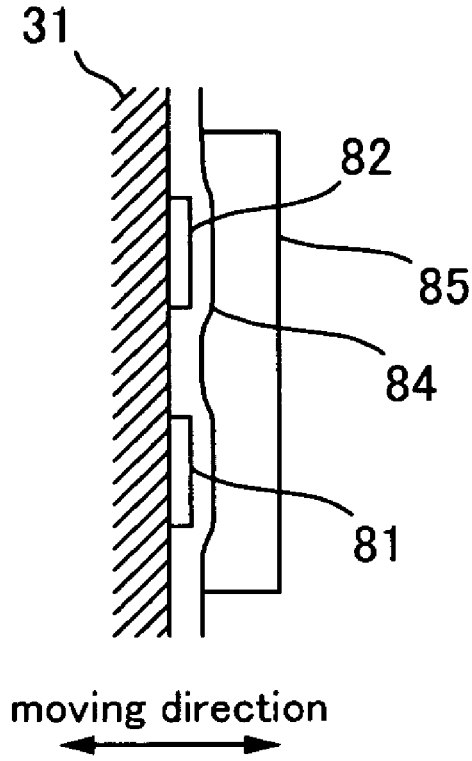

FIGS. 10A and 10B are diagrams for use in illustrating the electrodes 81 and 82 provided on the side surface of the carriage 31. As shown, the electrodes 81 and 82 are covered with a cover film 84. This is for the purpose of preventing short circuiting from being caused by adhering ink, as will be described. Note that in the example in FIG. 10B, an ink absorbing material 85 is also provided. A satellite ink droplet moving toward the electrodes is absorbed by the ink absorbing material 85. The use of the ink absorbing material 85 increases the recoverable amount of ink.

<Charging Electrodes in Attraction Unit 80>

Figure 11:
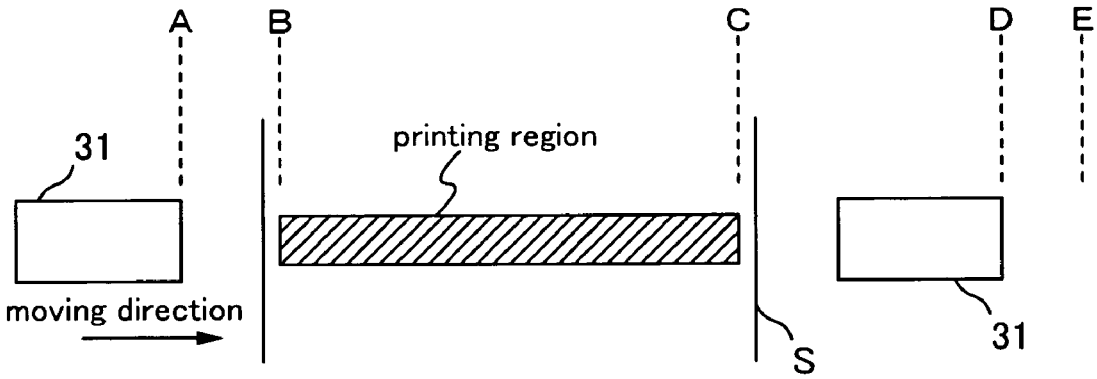
FIG. 11 is a diagram for use in illustrating the movement of the carriage 31 before and after dot forming processing.
Figure 12:
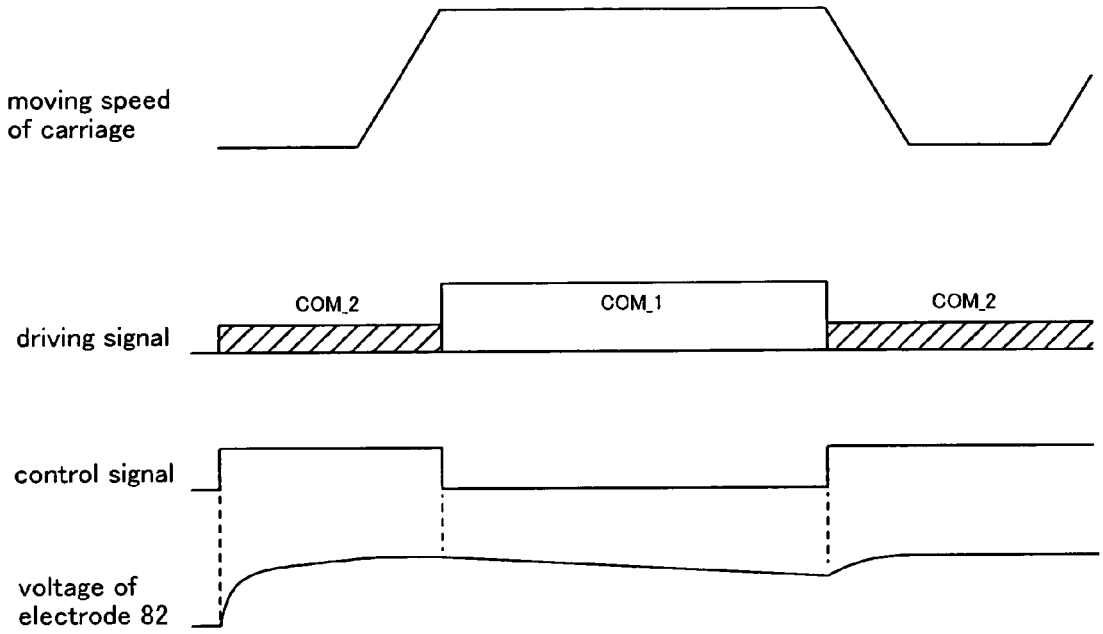
FIG. 12 is a chart for use in illustrating the relation between the driving signals COM, the control signal, and the voltage of the electrode 82 before and after dot forming processing.

FIG. 11 is a diagram for use in illustrating the movement of the carriage 31 before and after dot forming processing. FIG. 12 is a chart for use in illustrating the relation between the driving signal COM, the control signal, and the voltage at the electrode 82 before and after the dot forming processing. Now, the processing after the carriage 31 stationed at the left side of the paper S in FIG. 11 moves to the right side of the paper S until it stops for dot forming processing will be described. In the following description, the position of the carriage 31 on the right side surface is the reference position.

First, the carriage 31 is stationed in the position A. At the time, the driving signal generating section 70 generates the driving signal COM_2 as the micro-vibration signal and thus slightly vibrates the piezo elements 411 to prevent the nozzles from being clogged. At the time, the controller 60 pulls the control signal to be output to the attraction unit 80 to an H level, which turns on the switch 832. In this way, the primary winding of the transformer 834 is provided with the signal COM_2 having its DC component cut by the capacitor C2. The AC signal having its voltage level converted to a high level by the transformer 834 is rectified by the half wave rectifier circuit of the diode 836 and the capacitor C2. As the driving signal COM_2 continues to be input to the attraction unit 80 while the switch 832 is kept on (which will hereinafter be referred to as "charged state"), the voltage of the electrode 82 is raised to several hundred volts.

The controller 60 accelerates the carriage 31 in the moving direction (to the right in this example) from the position A and the carriage 31 is accelerated to a prescribed speed before it reaches the position B. The attraction unit 80 is kept in a charged state during the acceleration of the carriage 31.

The controller 60 moves the carriage 31 at a prescribed constant speed, and ink starts to be ejected when the head 41 reaches the position B. At the time, in order to form dots in a printing region, the driving signal generating section 70 switches the driving signal to be generated from the driving signal COM_2 to the driving signal COM_1. When the driving signal generating section 70 switches the driving signal, the controller 60 pulls the control signal to be output to the attraction unit 80 to an L level in order to turn off the switch 832. This is because if the driving signal COM_1 is input to the attraction unit 80 during ink ejection, the current is passed to the attraction unit 80 and the waveform of the driving pulses to be applied to the piezo elements 411 could be deformed.

During the period after the head 41 reaches the position B and before it passes the position C, the controller 60 moves the carriage 31 at a constant speed and allows ink to be intermittently ejected from the head 41, so that dots form in the shown printing region. In this way, a band-shaped piece of image is printed on the paper S. During the period, the switch 832 is kept in an off state. However, the voltage of the electrode 82 is kept substantially constant by the diode 836 and the capacitor C2.

When the head 41 passes the position C, the controller 60 stops the ink ejection and starts deceleration. At the time, the driving signal generating section 70 switches the driving signal to be generated from the driving signal COM_1 to the driving signal COM_2. After the switching between the driving signals, the controller 60 pulls the control signal to be applied to the attraction unit 80 to an H level and turns on the switch 832. More specifically, a charged state is regained. The controller 60 then stops the carriage 31 at the position D. While the carriage 31 is stopped at the position D, the attraction unit 80 continues to be in the charged state. When the carriage 31 moves in the opposite direction, substantially the same processing is carried out.

When the flushing processing is carried out, the controller 60 moves the carriage 31 to the position E of the ink receiving section. During the movement of the carriage 31, the controller 60 controls the driving signal generating section 70 to generate the driving signal COM_2, so that the nozzles are prevented from being clogged. The controller 60 also pulls the control signal to be output to the attraction unit 80 to an H level and turns on the switch 832, and thus a charged state is attained. After the carriage 31 is moved to the position E, the controller 60 controls the driving signal generating section 70 to generate the driving signal COM_1 and allows ink to be ejected from the head 41. At the time, the controller 60 pulls the control signal to be output to the attraction unit 80 to an L level, so that the switch 832 is turned off. After the flushing processing, the controller 60 controls the driving signal generating section 70 to generate the driving signal COM_2 to prevent the nozzles from being clogged, and also pulls the control signal to be output to the attraction unit 80 to an H level to thus turn on the switch 832, so that a charged state is attained.

According to the embodiment, the controller 60 keeps the attraction unit 80 in a charged state immediately before ink is ejected from the head 41. Therefore, even if the switch 832 is turned off when the ink is to be ejected from the head 41, the electrode 82 is kept at several hundred volts.

<Attraction of Satellite Ink Droplets>

Figure 13:
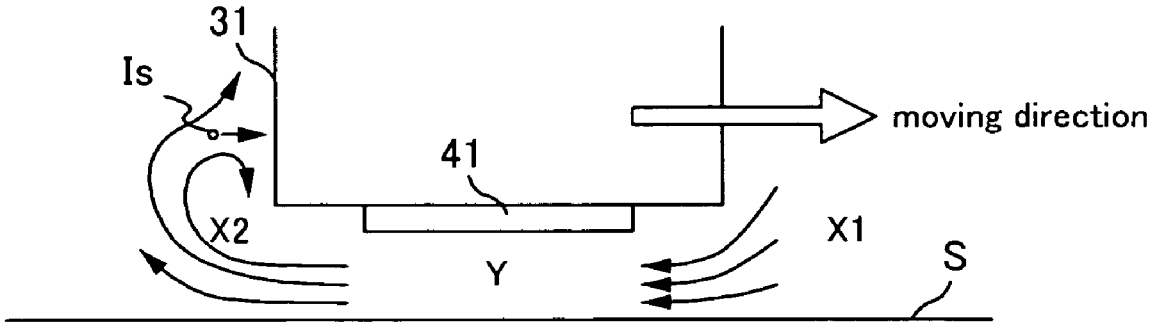
FIG. 13 is a diagram for use in illustrating the state of the airflow around the carriage 31 during dot forming processing.

FIG. 13 is a diagram for use in illustrating the airflow around the carriage 31 during dot forming processing. When the carriage 31 moves from the left to the right, the space X1 is abruptly narrowed by the carriage 31 or the head 41. As a result, an airflow is generated from the space X1 to the space Y.

When ink droplets are ejected from the head 41, part of the satellite ink droplet Is does not land on paper S due to air resistance, and is changed into a mist state. The mist-like satellite ink droplet Is is carried by the airflow from the space X1 to the space X2.

The cross section of the airflow increases rapidly from the space Y to the space X2 and a swirl forms at the left side surface (side surface downstream in the moving direction) of the carriage 31. The mist-like satellite ink droplet Is is gathered into the swirl, and then the satellite ink droplet moves toward the left side surface of the carriage 31.

The electrode 82 provided on the left side surface of the carriage 31 is charged to several hundred volts, while the satellite ink droplet Is is negatively charged. Therefore, the satellite ink droplet Is moved toward the left side surface of the carriage 31 moves further toward the electrode 82 and is attracted by the electrode (i.e., adheres to the electrode). Stated differently, by providing the electrodes of the attraction unit 80 on the side surface of the carriage 31, satellite ink droplets can efficiently be attracted using the airflow.

Other Embodiments

The above described embodiments are mainly related to printers, while it goes without saying that the disclosure covers a printing apparatus, a recording apparatus, a liquid ejecting apparatus, a printing method, a recording method, a liquid ejecting method, a printing system, a recording system, a computer system, a program, a medium storing a program, a method of manufacturing a printed material, and the like.

The printer and the like have been described as one embodiment of the invention, while the embodiment is illustrated for the ease of understanding the invention, and the same is by no means for limiting the invention. It is understood that the invention may be modified and improved without being departed from the scope of the invention, and the invention includes equivalents thereof. The following embodiments are covered by the scope of the invention.

<Nozzles>

In the above described embodiments, ink is ejected using piezoelectric elements. The method of ejecting liquid is not limited to the arrangement. Any other method such as a method of generating bubbles in the nozzles by heat may be employed. As long as ejected ink droplets are electrically charged, the ink droplets can be recovered by the attraction unit 80 when they are changed into a mist state.

Overview (1) The printer described above (as an example of a printing apparatus) includes the carriage 31 for moving the nozzles. When an ink droplet is ejected from a nozzle, the flying speed of the ink droplet is lowered by air resistance and the droplet sometimes scatters and does not land on a medium. Meanwhile, as shown in FIG. 8E, the ink droplet ejected from the nozzle is electrically charged by the effect of the friction between the nozzle and the ink at the time of ejection.

The embodiment takes advantage of the electrically-charged state of the mist-like ink droplet to attract the mist-like ink droplet. More specifically, the electrode 82 provided on the carriage 31 is charged to generate an electric field. The charged ink droplet is drawn toward and attracted by the electric field. In this way, the ink droplet can be attracted before it scatters, so that the printer can be prevented from being contaminated inside.

(2) According to the above described embodiment, the electrode is provided on the side surface of the carriage 31 (the front or back surface of the carriage in view of the carriage moving direction) in the moving direction (see FIGS. 2B, 10A, and 10B). In this way, using the airflow created at the side surface of the carriage 31 when the carriage 31 moves, mist-like ink droplets can adhere to the electrode efficiently (see FIG. 13).

The electrode may be provided in different positions such as on the lower surface of the carriage 31. In this case, however, ink droplets cannot efficiently be recovered using the airflow.

(3) According to the above described embodiment, a main ink droplet Im and a satellite ink droplet Is are ejected from a nozzle, and the satellite ink droplet among them is attracted by the electrode. This is because the satellite ink droplet Is is more easily changed into a mist state.

The ink droplets to be attracted are however not limited to satellite ink droplets. Main ink droplets not landing on paper S and changed into a mist state may be attracted to the electrode.

(4) According to the embodiment, the printer includes the driving signal generating section 70 that generates the driving signal COM (an example of a driving signal for driving a piezo element (as an example of an element for causing ink droplets to be ejected from the nozzle)), and a charging circuit 83 that charges electrodes (see FIG. 9). The charging circuit 83 charges the electrodes using the driving signal generated by the driving signal generating section 70. In this way, the structure can be simplified.

However, the charging circuit is not limited to this arrangement. For example, a signal different from the signal from the driving signal generating section may be used to charge the electrodes. In this case, however, another circuit to generate the other signal is necessary.

The charging circuit 83 described above has the following structure because the circuit uses the driving signals generated by the driving signal generating section 70.

(5) The above-described charging circuit 83 has the capacitor C1 (an example of a filter) that cuts the DC component of the signals output from the driving signal generating section 70 (see FIG. 9). Without the capacitor C1, short-circuiting can be caused when the driving signal is at a constant voltage.

Any other configurations may be employed instead of the use of the capacitor C1 as long as they can cut the DC component.

(6) The above described charging circuit 83 is provided with the transformer 834 (see FIG. 9). In this way, the electrodes can be charged with a voltage level higher than that of the signal output from the driving signal producing circuit 70. Consequently, more ink droplets can be attracted.

(7) On the secondary side of the transformer 834 in the above described charging circuit 83, the rectifier circuit including the diode 836 and the capacitor C2 is provided (see FIG. 9). In this way, the voltage of the charged electrode can be maintained.

(8) The above-described charging circuit 83 is provided with the switch 832 (see FIG. 9). Charging operation using the signal output from the driving signal generating section 70 is turned on/off in response to the on/off state of the switch 832.

(9) According to the above-described embodiment, when ink droplets are ejected from a nozzle, the switch 832 is turned off (see FIG. 12). This is because if the driving signal COM_1 is input to the attraction unit 80 during the ink ejection, the waveform of driving pulses applied to the piezo element 411 could be deformed. If such a deformed driving pulse is applied to a piezo element 411, ink droplets having a desired size cannot be ejected, so that dots having a desired size cannot be formed on paper, degrading the image quality of a printed image.

However, when ink droplets are ejected from a nozzle, the switch 832 may be turned on. The electrodes can be charged using the driving signal COM_1 in this way. In this case, however, the image quality of a printed image can degrade.

Note that during the flushing processing, the switch 832 may be turned on. During the flushing processing, the inability of forming ink droplets having a desired size does not affect the image quality of printed images.

(10) According to the above-described embodiment, the switch 832 is turned on when the piezo elements 411 are driven in response to a micro-vibration signal to such a degree that ink droplets are not ejected (see FIG. 12). This is because when charging operation is carried out during this period, the image quality of printed images is not affected. Even if the waveform of driving pulses to be applied to the piezo elements 411 is slightly deformed, the ink in the nozzles can be stirred as intended.

(11) According to the above-described embodiment, the electrodes are charged before an ink droplet is ejected from a nozzle (FIG. 12). For example, the electrode is charged while the carriage 31 is stopped and accelerated, and then ink droplets to form dots are ejected from the nozzles. In this way, ink droplets changed into a mist state during the dot forming processing can be attracted immediately before they scatter.

(12) According to the above-described embodiment, the electrodes are covered (FIGS. 10A and 10B). This is for the purpose of preventing ink from directly adhering to the electrodes and short-circuiting from being caused.

(13) According to the above-described embodiment, the ink absorbing material 85 is provided in the vicinity of the electrodes. In this way, ink droplets attracted to the electrodes can be absorbed into the ink absorbing material 85.

What is claimed is:

1. A printing apparatus comprising:

a carriage for moving a nozzle;

an electrode that moves with the carriage, the electrode being adapted to attract an electrically-charged ink droplet ejected from the nozzle but not landing on a medium;

a driving signal generating section for generating a driving signal that drives an element for causing an ink droplet to be ejected from the nozzle, and a charging circuit for charging the electrode using the signal output from the driving signal generating section.

2. A printing apparatus according to claim 1, wherein the electrode is provided on a side surface of the carriage in a moving direction of the carriage.

3. A printing apparatus according to claim 1, wherein a main ink droplet and a satellite ink droplet are ejected from the nozzle, and wherein the satellite ink droplet is attracted by the electrode.

4. A printing apparatus according to claim 1, wherein the charging circuit has a filter that cuts a DC component of the signal output from the driving signal generating section.

5. A printing apparatus according to claim 4, wherein the charging circuit has a transformer that converts a voltage of the signal whose DC component has been cut.

6. A printing apparatus according to claim 5, wherein the charging circuit has a rectifier circuit provided on a secondary side of the transformer.

7. A printing apparatus according to claim 1, wherein the charging circuit has a switch for controlling on/off of a charging operation which uses the signal output from the driving signal generating section.

8. A printing apparatus according to claim 7, wherein the switch is turned off when an ink droplet is to be ejected from the nozzle.

9. A printing apparatus according to claim 7, wherein the switch is turned on when the element is to be driven to such a degree that no ink droplet is ejected from the nozzle.

10. A printing apparatus according to claim 9, wherein the electrode is charged before an ink droplet is ejected from the nozzle.

11. A printing apparatus according to claim 1, wherein the electrode is covered.

12. A printing apparatus according to claim 1, wherein the printing apparatus further comprises an ink absorbing material that moves with the carriage.

13. A printing apparatus comprising:

a carriage for moving a nozzle; and an electrode that moves with the carriage, the electrode being adapted to attract an electrically-charged ink droplet ejected from the nozzle but not landing on a medium, wherein the electrode is provided on a side surface of the carriage in a moving direction of the carriage, wherein a main ink droplet and a satellite ink droplet are ejected from the nozzle, wherein the satellite ink droplet is attracted by the electrode, wherein the printing apparatus further comprises a driving signal generating section for generating a driving signal that drives an element for causing an ink droplet to be ejected from the nozzle, and a charging circuit for charging the electrode using the signal output from the driving signal generating section, wherein the charging circuit has a filter that cuts a DC component of the signal output from the driving signal generating section, wherein the charging circuit has a transformer that converts a voltage of the signal whose DC component has been cut, wherein the charging circuit has a rectifier circuit provided on a secondary side of the transformer, wherein the charging circuit has a switch for controlling on/off of a charging operation which uses the signal output from the driving signal generating section, wherein the switch is turned off when an ink droplet is to be ejected from the nozzle, wherein the switch is turned on when the element is to be driven to such a degree that no ink droplet is ejected from the nozzle, wherein the electrode is charged before an ink droplet is ejected from the nozzle, wherein the electrode is covered, and wherein the printing apparatus further comprises an ink absorbing material that moves with the carriage.

14. A printing apparatus comprising:

a carriage for moving a nozzle; and an electrode that moves with the carriage, the electrode being adapted to attract an electrically-charged ink droplet ejected from the nozzle but not landing on a medium, wherein the electrode is provided on a side surface of the carriage in a moving direction of the carriage.

* * * * *